US005952790A

United States Patent [19]

Nerone et al.

[11] Patent Number: 5,952,790

[45] **Date of Patent: *Sep. 14, 1999**

[54] LAMP BALLAST CIRCUIT WITH SIMPLIFIED STARTING CIRCUIT

[75] Inventors: Louis R. Nerone, Brecksville; Gordon A. Grigor, Cleveland Heights; Kurt W. Haas, Chesterland, all of Ohio

[73] Assignee: General Electric Company, Schenectady, N.Y.

[ * ] Notice: This patent issued on a continued prosecution application filed under 37 CFR 1.53(d), and is subject to the twenty year patent term provisions of 35 U.S.C. 154(a)(2).

[21] Appl. No.: 08/709,064

[22] Filed: Sep. 6, 1996

[51] Int. Cl.[6] ..... H05B 37/00

[52] U.S. Cl. ..... 315/209 R; 315/219; 315/224; 315/307

[58] Field of Search ..... 315/DIG. 7, 209 R, 315/219, 224, 307, 291

[56] References Cited

U.S. PATENT DOCUMENTS

| | | | |
|---|---|---|---|
| 4,382,212 | 5/1983 | Bay | 315/DIG. 7 |
| 4,463,286 | 7/1984 | Justice . | |
| 4,525,650 | 6/1985 | Hicks et al. | 315/DIG. 7 |
| 4,546,290 | 10/1985 | Kerekes . | |
| 4,588,925 | 5/1986 | Fahnrich et al. . | |
| 4,647,817 | 3/1987 | Fahnrich et al. . | |
| 4,667,345 | 5/1987 | Nilssen . | |
| 4,692,667 | 9/1987 | Nilssen . | |
| 4,937,470 | 6/1990 | Zeller . | |
| 4,945,278 | 7/1990 | Chern . | |
| 5,223,767 | 6/1993 | Kulka . | |
| 5,309,062 | 5/1994 | Perkins et al. . | |
| 5,341,068 | 8/1994 | Nerone . | |
| 5,349,270 | 9/1994 | Roll et al. . | |
| 5,387,847 | 2/1995 | Wood . | |
| 5,406,177 | 4/1995 | Nerone . | |
| 5,514,981 | 5/1996 | Tam et al. . | |

OTHER PUBLICATIONS

Carr "Designing & Building Electronic Gadgets with Projects" 1984 Tab books pp. 44–45.

*Primary Examiner*—Michael B Shingleton
*Attorney, Agent, or Firm*—Charles E. Bruzga

[57] ABSTRACT

A ballast circuit for a gas discharge lamp comprises a resonant load circuit incorporating the gas discharge lamp and including a resonant inductance and a resonant capacitance. A d.c.-to-a.c. converter circuit induces an a.c. current in the resonant load circuit. The converter circuit comprises first and second switches serially connected between a bus conductor at a d.c. voltage and a reference conductor, and which are connected together at a common node through which the a.c. load current flows. A voltage-breakover (VBO) device is effectively connected between the common node and a second node. A network is provided for setting the voltage of the second node with respect to the common node at less than the breakover voltage of the VBO device when the lamp is operating at steady state. A polarity-determining impedance is connected between the common node and one of the bus conductor and the reference conductor, to set the initial polarity of pulse to be generated upon the firing of the VBO device.

22 Claims, 8 Drawing Sheets

LAMP BALLAST CIRCUIT WITH SIMPLIFIED STARTING CIRCUIT

FIELD OF THE INVENTION

The present invention relates to ballasts, or power supply, circuits for gas discharge lamps of the type employing regenerative gate drive circuitry for controlling a pair of serially connected switches of an d.c.-to-a.c. converter. A first aspect of the invention relates to such a ballast circuit employing an inductance in the gate drive circuitry to adjust the phase of a voltage that controls the serially connected switches. A second aspect of the invention, claimed herein, relates to the mentioned type of ballast circuit that employs a novel circuit for starting regenerative operation of the gate drive circuity.

BACKGROUND OF THE INVENTION

Regarding a first aspect of the invention, typical ballast circuits for a gas discharge lamp include a pair of serially connected MOSFETs or other switches, which convert direct current to alternating current for supplying a resonant load circuit in which the gas discharge lamp is positioned. Various types of regenerative gate drive circuits have been proposed for controlling the pair of switches. For example, U.S. Pat. No. 5,349,270 to Roll et al. ("Roll") discloses gate drive circuitry employing an R-C (resistive-capacitive) circuit for adjusting the phase of gate-to-source voltage with respect to the phase of current in the resonant load circuit. A drawback of such gate drive circuitry is that the phase angle of the resonant load circuit moves towards 90° instead of toward 0° as the capacitor of the R-C circuit becomes clamped, typically by a pair of back-to-back connected Zener diodes. These diodes are used to limit the voltage applied to the gate of MOSFET switches to prevent damage to such switches. The resulting large phase shift prevents a sufficiently high output voltage that would assure reliable ignition of the lamp, at least without sacrificing ballast efficiency.

Additional drawbacks of the foregoing R-C circuits are soft turn-off of the MOSFETs, resulting in poor switching, and a slowly decaying ramp of voltage provided to the R-C circuit, causing poor regulation of lamp power and undesirable variations in line voltage and arc impedance.

Regarding a second aspect of the invention, it would be desirable to provide a simple starting circuit for initiating regenerative action of gate drive circuitry for controlling the switches of a d.c.-to-a.c. converter in ballast circuits of the mentioned type.

OBJECTS AND SUMMARY OF THE INVENTION

It is an object of the first aspect of the invention to provide a gas discharge lamp ballast circuit of the type employing regenerative gate drive circuitry for controlling a pair of serially connected switches of an d.c.-to-a.c. converter, wherein the phase angle between a resonant load current and a control voltage for the switches moves towards 0° during lamp ignition, assuring reliable lamp starting.

A further object of the first aspect of the invention is to provide a ballast circuit of the foregoing type having a simplified construction compared to the mentioned prior art circuit of Roll, for instance.

An object of the second aspect of the invention is to provide a simple starting circuit for initiating regenerative action of gate drive circuitry for controlling the switches of a d.c.-to-a.c. converter in ballast circuits of the mentioned type.

A further object of the second aspect of the invention is to provide a simple starting circuit of the foregoing type that may be used in other ballast circuits which also employ a pair of serially connected switches in a d.c.-to-a.c. converter.

In accordance with a second aspect of the invention, claimed herein, there is provided a ballast circuit for a gas discharge lamp comprising a resonant load circuit incorporating the gas discharge lamp and including a resonant inductance and a resonant capacitance. A d.c.-to-a.c. converter circuit induces an a.c. current in the resonant load circuit. The converter circuit comprises first and second switches serially connected between a bus conductor at a d.c. voltage and a reference conductor, and which are connected together at a common node through which the a.c. load current flows. A voltage-breakover (VBO) device is effectively connected between the common node and a second node. A network is provided for setting the voltage of the second node with respect to the common node at less than the breakover voltage of the VBO device when the lamp is operating at steady state. A polarity-determining impedance is connected between the common node and one of the bus conductor and the reference conductor, to set the initial polarity of pulse to be generated upon the firing of the VBO device.

BRIEF DESCRIPTION OF THE DRAWINGS

The foregoing objects and further advantages and features of the invention will become apparent from the following description when taken in conjunction with the drawing, in which like reference numerals refer to like parts, and in which.

DETAILED DESCRIPTION OF THE PREFERRED EMBODIMENTS

First Aspect of Invention

The first aspect of the invention will now be described in connection with FIGS. 1–6B.

Figure 1:
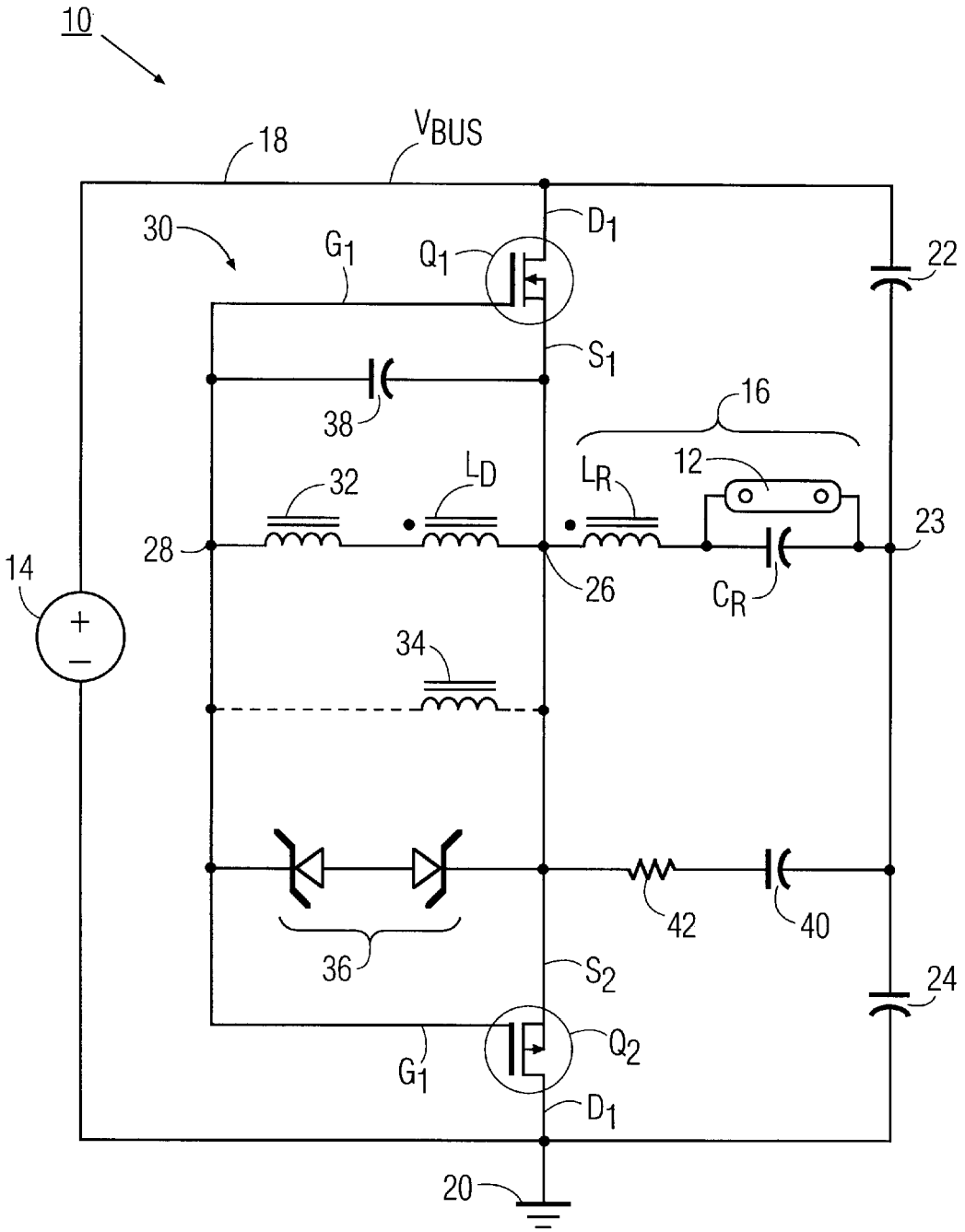
FIG. 1 is a schematic diagram of a ballast circuit for a gas discharge lamp employing complementary switches in a d.c.-to-a.c. converter, in accordance with a first aspect of the invention.

FIG. 1 shows a ballast circuit 10 for a gas discharge lamp 12 in accordance with a first aspect of the invention. Switches $Q_1$ and $Q_2$ are respectively controlled to convert d.c. current from a source 14, such as the output of a full-wave bridge (not shown), to a.c. current received by a resonant load circuit 16, comprising a resonant inductor $L_R$ and a resonant capacitor $C_R$. D.c. bus voltage $V_{BUS}$ exists between bus conductor 18 and reference conductor 20, shown for convenience as a ground. Resonant load circuit 16 also includes lamp 12, which, as shown, may be shunted across resonant capacitor $C_R$. Capacitors 22 and 24 are standard "bridge" capacitors for maintaining their commonly connected node 23 at about ½ bus voltage $V_{BUS}$. Other arrangements for interconnecting lamp 12 in resonant load circuit 16 and arrangements alternative to bridge capacitors 18 and 24 are known in the art.

In ballast 10 of FIG. 1, switches $Q_1$ and $Q_2$ are complementary to each other in the sense, for instance, that switch $Q_1$ may be an n-channel enhancement mode device as shown, and switch $Q_2$ a p-channel enhancement mode device as shown. These are known forms of MOSFET switches, but Bipolar Junction Transistor switches could also be used, for instance. Each switch $Q_1$ and $Q_2$ has a respective gate, or control terminal, $G_1$ or $G_2$. The voltage from gate $G_1$ to source $S_1$ of switch $Q_1$ controls the conduction state of that switch. Similarly, the voltage from gate $G_2$ to source $S_2$ of switch $Q_2$ controls the conduction state of that switch. As shown, sources $S_1$ and $S_2$ are connected together at a common node 26. With gates $G_1$ and $G_2$ interconnected at a common control node 28, the single voltage between control node 28 and common node 26 controls the conduction states of both switches $Q_1$ and $Q_2$. The drains $D_1$ and $D_2$ of the switches are connected to bus conductor 18 and reference conductor 20, respectively.

Gate drive circuit 30, connected between control node 28 and common node 26, controls the conduction states of switches $Q_1$ and $Q_2$. Gate drive circuit 30 includes a driving inductor $L_D$ that is mutually coupled to resonant inductor $L_R$, and is connected at one end to common node 26. The end of inductor $L_R$ connected to node 26 may be a tap from a transformer winding forming inductors $L_D$ and $L_R$. Inductors $L_D$ and $L_R$ are poled in accordance with the solid dots shown adjacent the symbols for these inductors. Driving inductor $L_D$ provides the driving energy for operation of gate drive circuit 30. A second inductor 32 is serially connected to driving inductor $L_D$, between node 28 and inductor $L_D$. As will be further explained below, second inductor 32 is used to adjust the phase angle of the gate-to-source voltage appearing between nodes 28 and 26. A further inductor 34 may be used in conjunction with inductor 32, but is not required, and so the conductors leading to inductor 34 are shown as broken. A bidirectional voltage clamp 36 between nodes 28 and 26 clamps positive and negative excursions of gate-to-source voltage to respective limits determined, e.g., by the voltage ratings of the back-to-back Zener diodes shown. A capacitor 38 is preferably provided between nodes 28 and 26 to predicably limit the rate of change of gate-to-source voltage between nodes 28 and 26. This beneficially assures, for instance, a dead time interval in the switching modes of switches $Q_1$ and $Q_2$ wherein both switches are off between the times of either switch being turned on.

A snubber circuit formed of a capacitor 40 and resistor 42 may be employed as is conventional, and described, for instance, in U.S. Pat. No. 5,382,882, issued on Jan. 17, 1995, to the present inventor, and commonly assigned.

Figure 2:
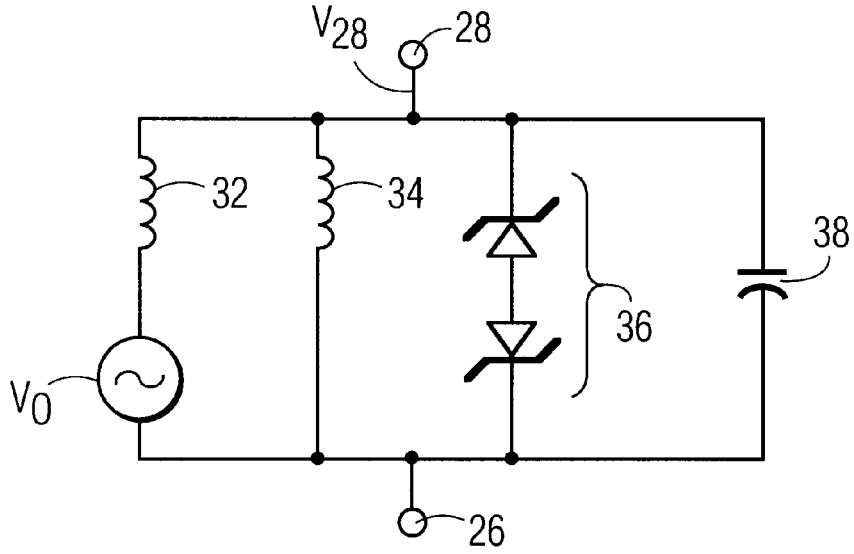
FIG. 2 is an equivalent circuit diagram for gate drive circuit 30 of FIG. 1.

FIG. 2 shows a circuit model of gate drive circuit 30 of FIG. 1. When the Zener diodes 36 are conducting, the nodal equation about node 28 is as follows:

$$-(1/L_{32})\int V_0 dt+(1/L_{32}+1L_{34})\int V_{28}dt+I_{36}=0 \quad (1)$$

where, referring to components of FIG. 1, $L_{32}$ is the inductance of inductor 32;

$V_0$ is the driving voltage from driving inductor $L_D$;

$L_{34}$ is the inductance of inductor 34;

$V_{28}$ is the voltage of node 28 with respect to node 26; and $I_{36}$ is the current through the bidirectional clamp 36.

In the circuit of FIG. 2, the current through capacitor 38 is zero while the voltage clamp 36 is on.

Figure 3:
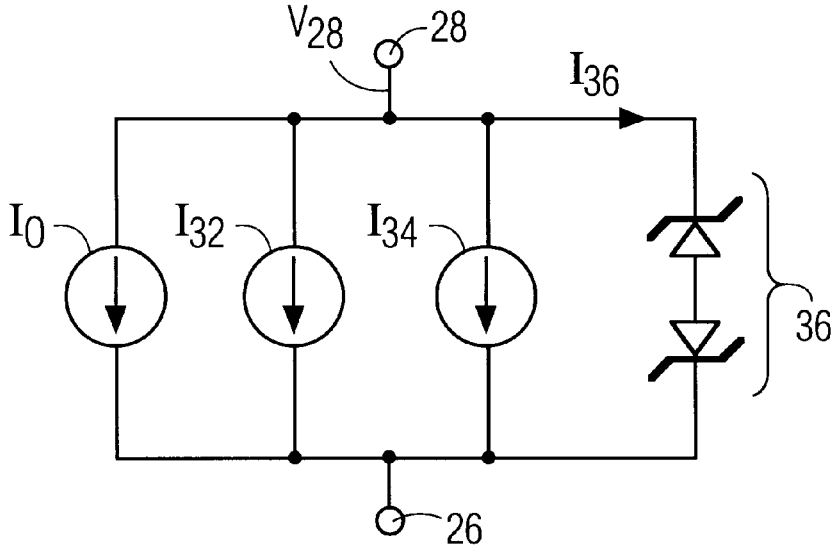
FIG. 3 is an another equivalent circuit diagram for gate drive circuit 30 of FIG. 1.

The circuit of FIG. 2 can be redrawn as shown in FIG. 3 to show only the currents as dependent sources, where $I_0$ is the component of current due to voltage $V_0$ (defined above) across driving inductor $L_D$ (FIG. 1). The equation for current $I_0$ can be written as follows:

$$I_0=(1/L_{32})\int V_0 dt \quad (2)$$

The equation for current $I_{32}$, the current in inductor 32, can be written as follows:

$$I_{32}=(1/L_{32})\int V_{28}dt \quad (3)$$

The equation for current $I_{34}$, the current in inductor 34, can be written as follows:

$$I_{34}=(1/L_{34})\int V_{28}dt \quad (4)$$

As can be appreciated from the foregoing equations (2)–(4), the value of inductor $L_{32}$ can be changed to include the values of both inductors $L_{32}$ and $L_{34}$. The new value for inductor $L_{32}$ is simply the parallel combination of the values for inductors 32 and 34.

Figure 4:
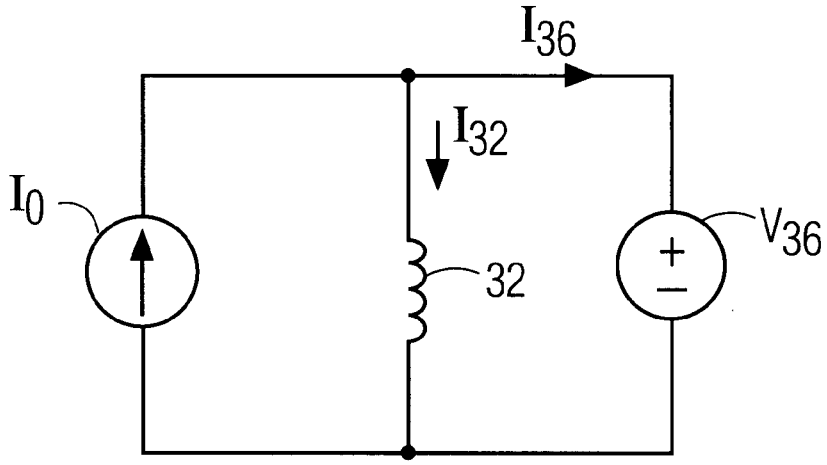
FIG. 4 is an equivalent circuit for gate drive circuit 30 of FIG. 1 when Zener diodes 36 of FIG. 1 are conducting.
Figure 5:
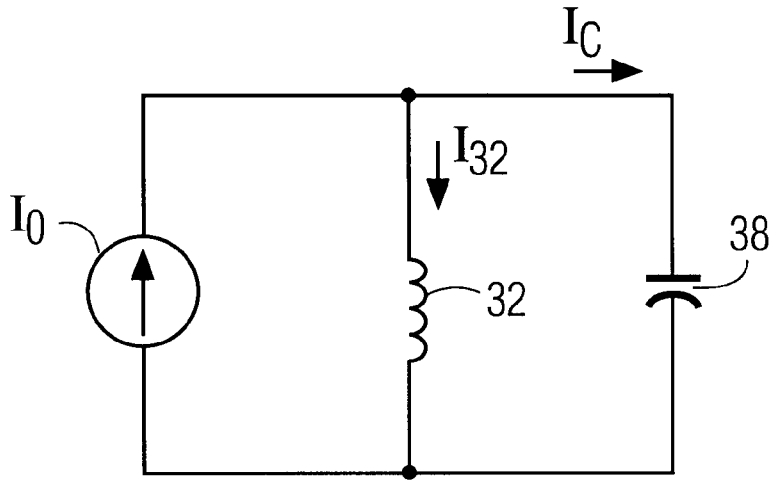
FIG. 5 is an equivalent circuit for gate drive circuit 30 of FIG. 1 when Zener diodes 36 of FIG. 1 are not conducting, and the voltage across capacitor 38 of FIG. 1 is changing state.

Now, with inductor 34 removed from the circuit of FIG. 1, the following circuit analysis explains operation of gate drive circuit 34. Referring to FIG. 4, with terms such as $I_0$ as defined above, the condition when the back-to-back Zener diodes of bidirectional voltage clamp 36 are conducting is now explained. Current $I_0$ can be expressed by the following equation:

$$I_0=(L_R/nL_{32})I_R \quad (5)$$

where $L_R$ (FIG. 1) is the resonant inductor;

n is the turns ratio as between $L_R$ and $L_D$; and $I_R$ is the current in resonant inductor $L_R$.

Current $I_{36}$ through Zener diodes 36 can be expressed by the following equation:

$$I_{36}=I_0-I_{32} \quad (6)$$

With Zener diodes 36 conducting, current through capacitor 38 (FIG. 1) is zero, and the magnitude of $I_0$ is greater than $I_{32}$. At this time, voltage $V_{36}$ across Zener diodes 36 (i.e. the gate-to-source voltage) is plus or minus the rated clamping voltage of one of the active, or clamping, Zener diode (e.g. 7.5 volts) plus the diode drop across the other, non-clamping, diode (e.g. 0.7 volts).

Then, with Zener diodes 36 not conducting, the voltage across capacitor 38 (FIG. 1) changes state from a negative value to a positive value, or vice-versa. The value of such voltage during this change is sufficient to cause one of switches $Q_1$ and $Q_2$ to be turned on, and the other turned off. As mentioned above, capacitor 38 assures a predictable rate of change of the gate-to-source voltage. Further, with Zener diodes 36 not conducting, the magnitude of $I_{32}$ is greater than the value of $I_0$. At this time, current $I_C$ in capacitor 38 can be expressed as follows:

$$I_C = I_0 - I_{32} \quad (7)$$

Current $I_{32}$ is a triangular waveform. Current $I_{36}$ (FIG. 4) is the difference between $I_0$ and $I_{32}$ while the gate-to-source voltage is constant (i.e., Zener diodes 36 conducting). Current $I_C$ is the current produced by the difference between $I_0$ and $I_{32}$ when Zener diodes 36 are not conducting. Thus, $I_C$ causes the voltage across capacitor 38 (i.e., the gate-to-source voltage) to change state, thereby causing switches $Q_1$ and $Q_2$ to switch as described. The gate-to-source voltage is approximately a square wave, with the transitions from positive to negative voltage, and vice-versa, made predictable by the inclusion of capacitor 38.

Figure 6A:
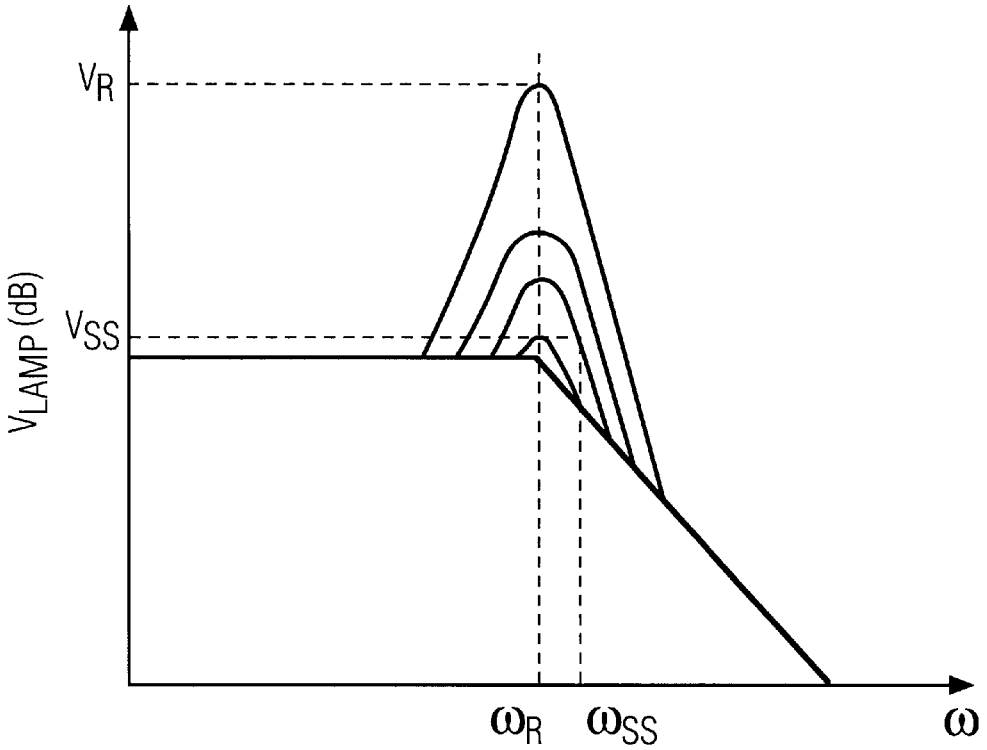
FIG. 6A is a simplified lamp voltage-versus-angular frequency graph illustrating operating points for lamp ignition and for steady state modes of operation.
Figure 6B:
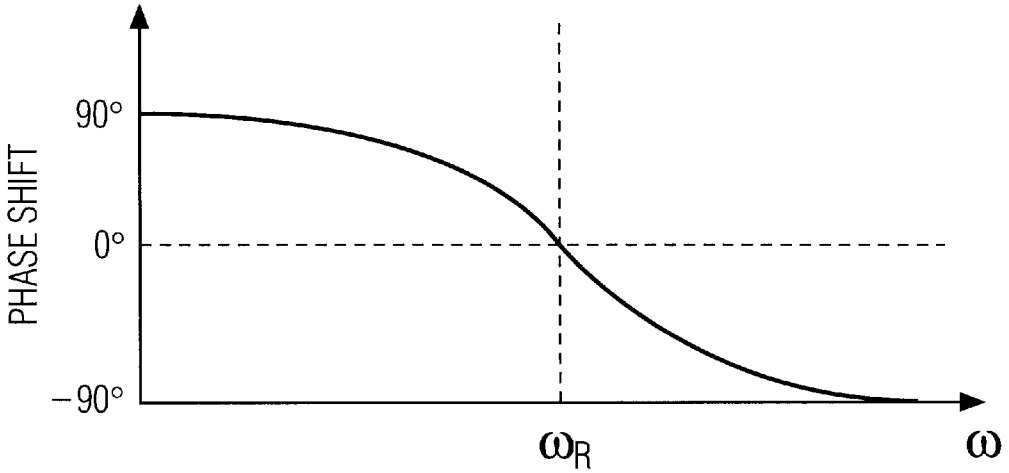
FIG. 6B illustrates the phase angle between a fundamental frequency component of a voltage of a resonant load circuit and the resonant load current as a function of angular frequency of operation.

Beneficially, the use of gate drive circuit 30 of FIG. 1 results in the phase shift of angle between the fundamental frequency component of the resonant voltage between node 26 and node 23 and the current in resonant load circuit 16 (FIG. 1) approaching 0° during ignition of the lamp. With reference to FIG. 6A, simplified lamp voltage $V_{LAMP}$ versus angular frequency curves are shown. Angular frequency $\omega_R$ is the frequency of resonance of resonant load circuit 16 of FIG. 1. At resonance, lamp voltage $V_{LAMP}$ is at its highest value, shown as $V_R$. It is desirable for the lamp voltage to approach such resonant point during lamp ignition. This is because the very high voltage spike generated across the lamp at such point reliably initiates an arc discharge in the lamp, causing it to start. In contrast, during steady state operation, the lamp operates at a considerably lower voltage $V_{SS}$, at the higher angular frequency $\omega_{SS}$. Now, referring to FIG. 6B, the phase angle between the fundamental frequency component of resonant voltage between nodes 26 and 23 and the current in resonant load circuit 16 (FIG. 1) is shown. Beneficially, this phase angle tends to migrate towards zero during lamp ignition. In turn, lamp voltage $V_{LAMP}$ (FIG. 6A) migrates towards the high resonant voltage $V_R$ (FIG. 6A), which is desirable, as explained, for reliably starting the lamp.

Some of the prior art gate drive circuits, as mentioned above, resulted in the phase angle of the resonant load circuit migrating instead towards 90° during lamp ignition, with the drawback that the voltage across the lamp at this time was lower than desired. Less reliable lamp starting thereby occurs in such prior art circuits.

Second Aspect of the Invention

Figure 7:
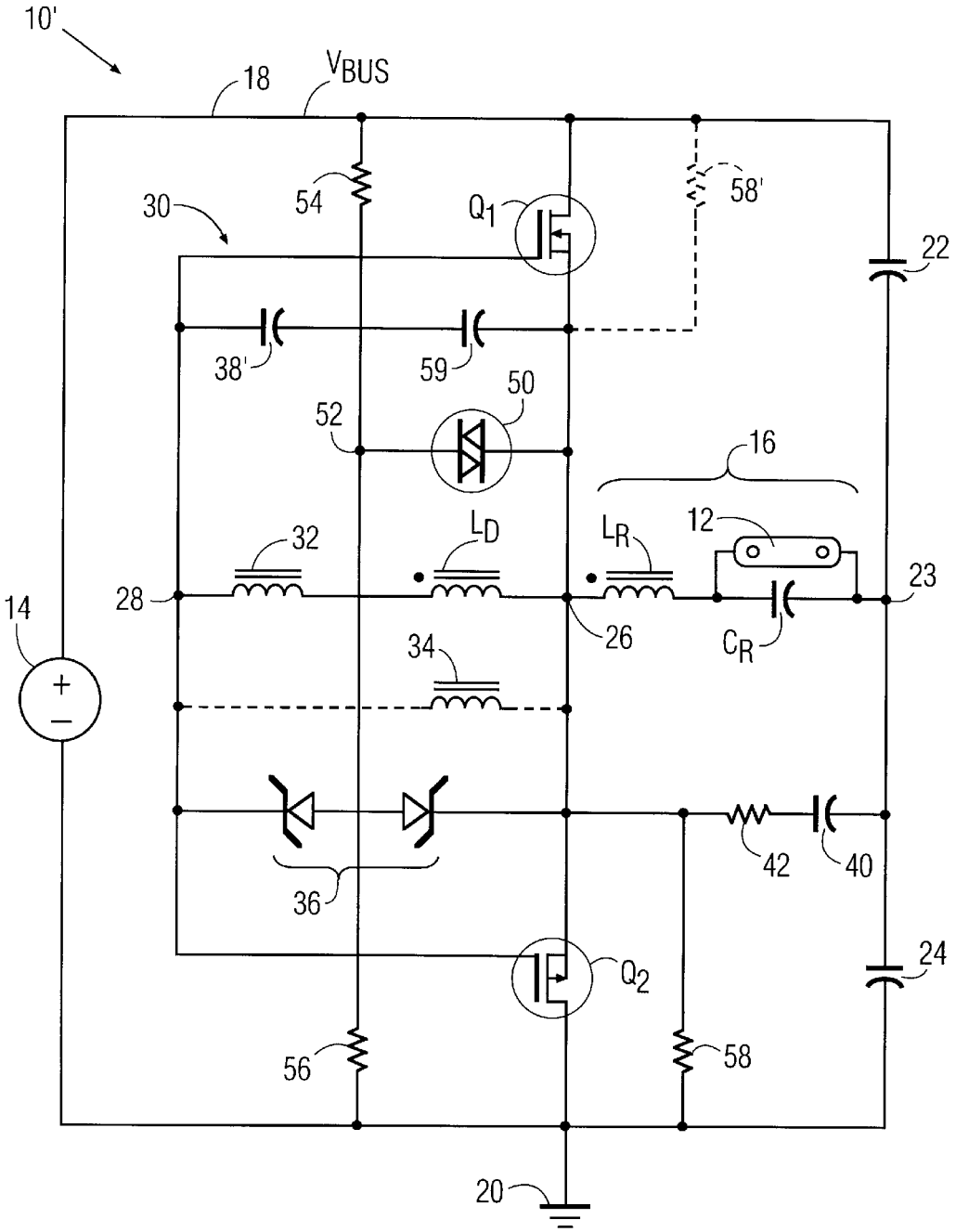
FIG. 7 is a schematic diagram similar to FIG. 1 but also showing a novel starting circuit, in accordance with a second aspect of the invention.

A second aspect of the invention is now described in connection with FIGS. 7–10. In FIG. 7, ballast circuit 10' is shown. It is identical to ballast 10 of FIG. 1, but also includes a novel starting circuit described below. As between FIGS. 1 and 7, like reference numerals refer to like parts, and therefore FIG. 1 may be consulted for description of such like-numbered parts.

The novel starting circuit includes a voltage-breakover (VBO) device 50, such as a diac. One node of VBO device 50 is connected effectively to common node 26, "effectively" being made more clear from the further embodiments of the second aspect of the invention described below. The other node of VBO device 50 is connected effectively to a second node 52. Network 54, 56 helps to maintain the voltage of second node 52 with respect to common node 26 at less than the breakover voltage of VBO device 50 during steady state operation of the lamp. Preferably, network 54, 56 comprises serially connected resistors 54 and 56, which are connected between bus conductor 18 and reference conductor 20. Resistors 54 and 56 form a voltage-divider network, and preferably are of equal value if the duty cycles of switches $Q_1$ and $Q_2$ are equal. In this case, the average voltage during steady state at node 26 is approximately ½ of bus voltage $V_{BUS}$, and setting the values of resistors 54 and 56 equal results in an average voltage at second node 52 also of approximately ½ bus voltage $V_{BUS}$. Capacitor 59 serves as a low pass filter to prevent substantial high frequency voltage fluctuations from being impressed across VBO device 50, and therefore performs an averaging function. The net voltage across VBO device 50 is, therefore, approximately zero in steady state.

A charging impedance 58 is provided, and may be connected between common node 26 and reference conductor 20, or, alternatively, as shown at 58' by broken lines, between node 26 and bus conductor 18. Additionally, a current-supply capacitor 59 effectively shunts VBO device 50 for a purpose explained below.

Upon initial energization of d.c. voltage source 14, inductors 32 and $L_D$ appear as a short circuit, whereby the left-shown node of capacitor 38' is effectively connected to the right-shown node of capacitor 59, i.e., at node 26. During this time, therefore, capacitors 38' and 59 may be considered to be in parallel with each other. Meanwhile, second node 52 of VBO device 50, to which both capacitors are connected, has the voltage of, e.g., ⅓ bus voltage $V_{BUS}$ due to the voltage-divider action of resistors 54, 56 and 58. With resistor 58 as shown in unbroken lines, the voltage of the nodes of capacitors 38' and 59 connected to second node 52 begins to increase, through a current path to reference conductor 20 that includes charging resistor 58. When the voltage across current-supply capacitor 59 reaches the voltage-breakover threshold of VBO device 50, such device abruptly drops in voltage. This can be appreciated from FIG. 8, which shows the I-V (or current-voltage) characteristic of a typical VBO embodied as a diac.

Figure 8:
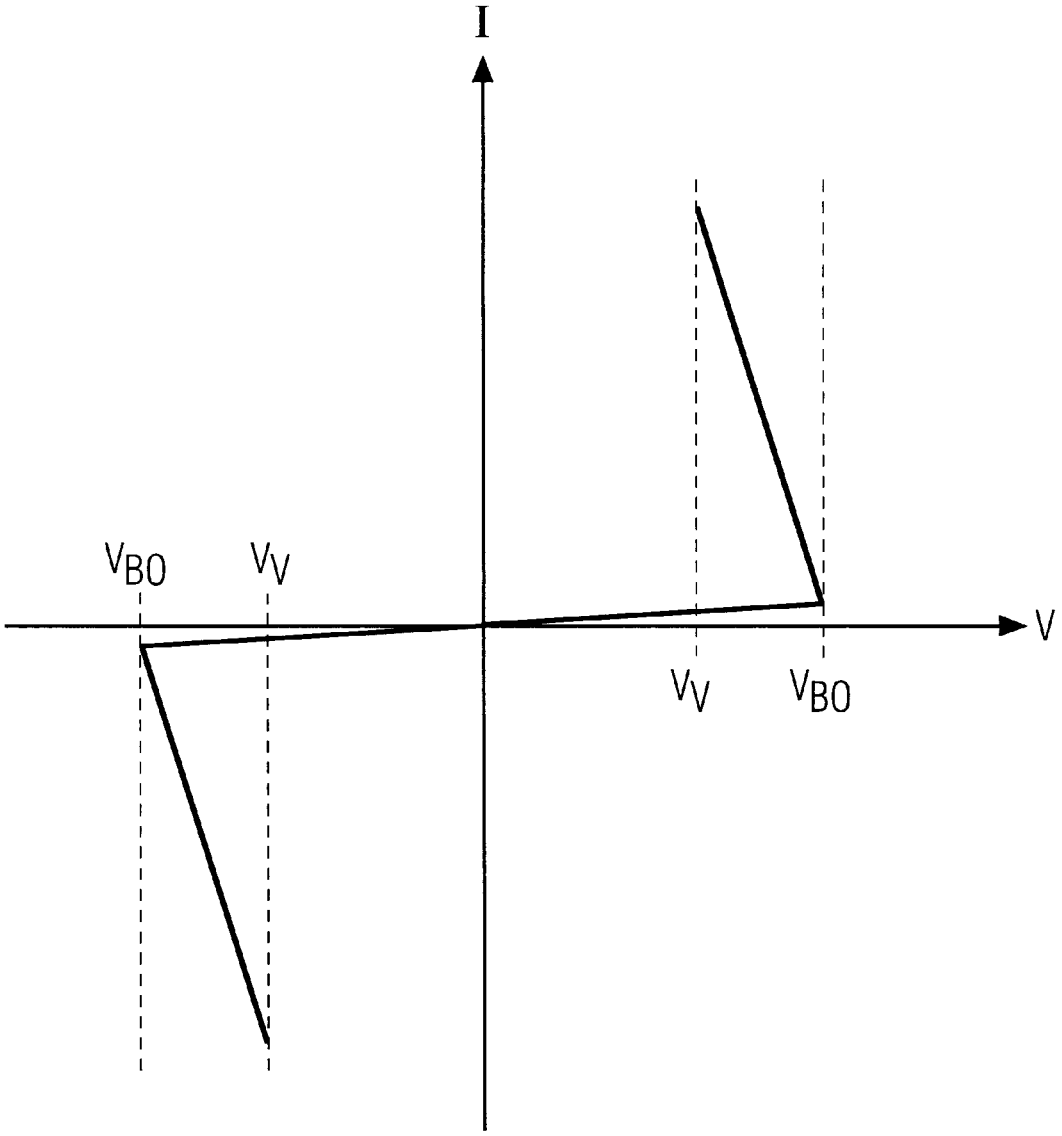
FIG. 8 shows an I-V (or current-voltage) characteristic of a typical diac.

As FIG. 8 shows, a diac is a symmetrical device in regard to positive or negative voltage excursions. Referring only to the positive voltage excursions for simplicity, it can be seen that the device breaks over at a breakover voltage $V_{BO}$, which may typically be about 32 volts. The voltage across the device will then fall to the so-called valley voltage $V_V$, which is typically about 26 volts, or about six volts below the breakover voltage $V_{BO}$. In ballast 10' of FIG. 7, to supply current to VBO device 50 to enable it to transition from breakover voltage $V_{BO}$ to valley voltage $V_V$, current supply capacitor 59 supplies current to the device from its stored charge. The rapid decrease in voltage of VBO device 50 (i.e. a voltage pulse) is coupled by capacitor 38' to second inductor 32 and driving inductor $L_D$, which no longer act as a short circuit owing to the high frequency content of the current pulse. The current pulse induces a gate-to-source voltage pulse across the inductors, whose polarity is determined by whether charging resistor 58 shown in solid lines is used, or whether charging resistor 58' shown in broken lines is used. Such resistor, therefore, is also referred to herein as a polarity-determining impedance. Such gate-to-source voltage pulse serves as a starting pulse to cause one or the other of switches $Q_1$ and $Q_2$ to turn on.

As mentioned above, during steady state lamp operation, both nodes of VBO device 50 are maintained sufficiently close to each other in voltage so as to prevent its firing.

Exemplary component values for the circuit of FIG. 7 (and hence of FIG. 1) are as follows for a fluorescent lamp 12 rated at 16.5 watts, with a d.c. bus voltage of 160 volts, and not including inductor 34:

| | |
|---|---|
| Resonant inductor $L_R$ | 570 micro henries |
| Driving inductor $L_D$ | 2.5 micro henries |
| Turns ratio between $L_R$ and $L_D$ | 15 |
| Second inductor 32 | 150 micro henries |
| Capacitor 38' | 3.3 nanofarads |
| Capacitor 59 | 0.1 microfarads |
| Capacitor 38 (FIG. 1) if capacitor 59 not used | 3.3 nanofarads |
| Zener diodes 36, each | 7.5 volts |
| Resistors 54, 56, 58, and 58', each | 100k ohms |
| Resonant capacitor $C_R$ | 3.3 nanofarads |
| Bridge capacitors 22 and 24, each | 0.22 microfarads |
| Resistor 42 | 10 ohms |
| Snubber capacitor 40 | 470 picofarads |

Additionally, switch $Q_1$ may be an IRFR210, n-channel, enhancement mode MOSFET, sold by International Rectifier Company, of El Segundo, Calif.; switch $Q_2$, an IRFR9210, p-channel, enhancement mode MOSFET also sold by International Rectifier Company; and VBO device 50, a diac sold by Philips Semiconductors of Eindhoven, Netherlands, with a 34-volt breakover voltage, part No. BR100/03.

Figure 9:
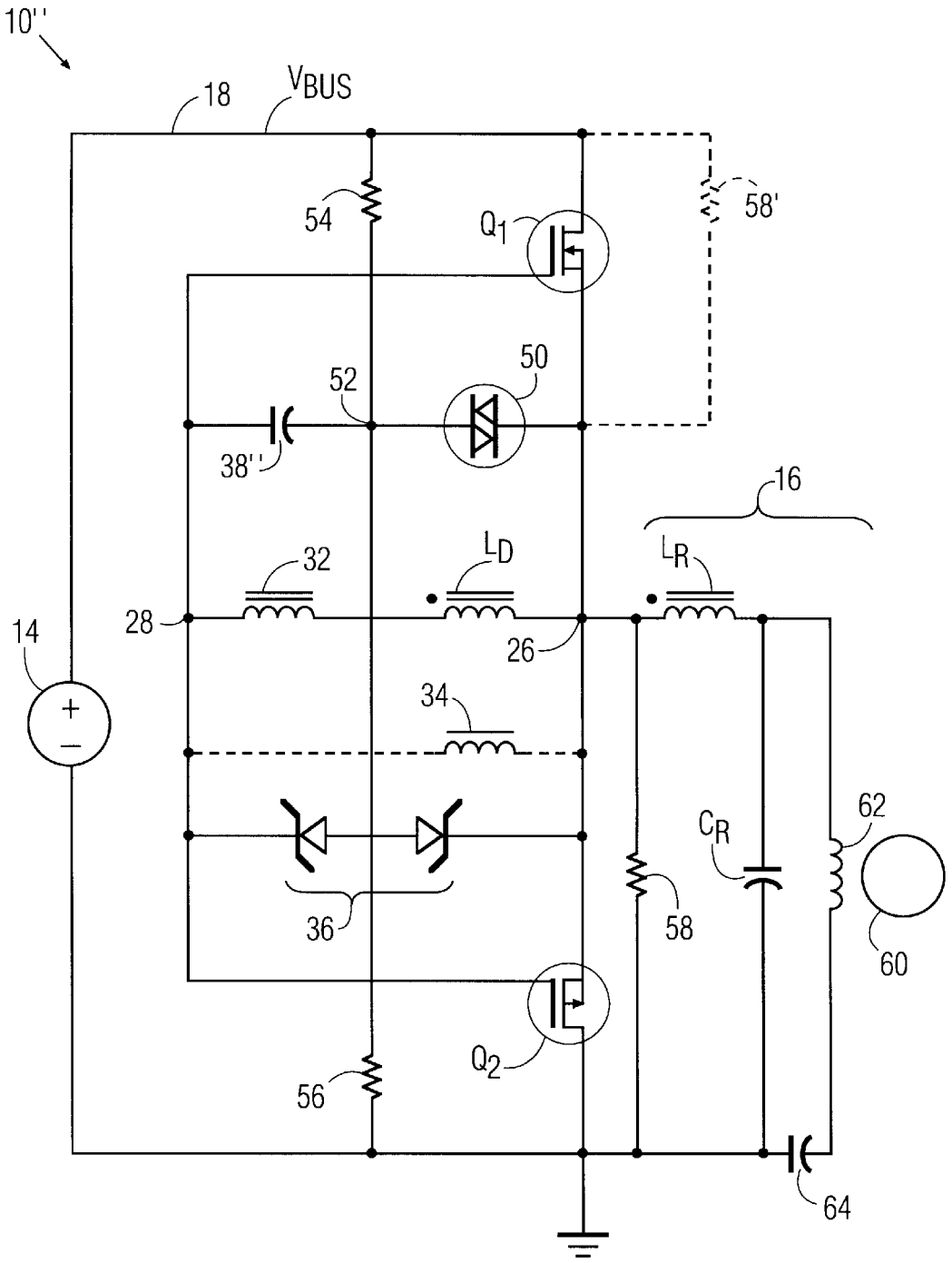
FIG. 9 is a schematic diagram showing a ballast circuit for an electrodeless lamp that embodies principles of both the first and second aspects of the invention.

FIG. 9 shows a ballast circuit 10" embodying principles of the first aspect of the invention, and also embodying principles of the second aspect of the invention. Circuit 10" is particularly directed to a ballast circuit for an electrodeless lamp 60, which may be of the fluorescent type. Lamp 60 is shown as a circle representing the plasma of an electrodeless lamp. An RF coil 62 provides the energy to excite the plasma into a state in which it generates light. A d.c. blocking capacitor 64 may be used rather than the bridge capacitors 22 and 24 shown in FIG. 1. Circuit 10" operates at a frequency typically of about 2.5 Megahertz, which is about 10 to 20 times higher than for the electroded type of lamp powered by ballast circuit 10 of FIG. 1 or circuit 10' of FIG. 7. During steady state operation, capacitor 38" functions as a low pass filter to maintain the potential on node 52 within plus or minus the clamping voltage of clamping circuit 36 (e.g., +/−8 volts). With the potential of node 28 being within plus or minus the mentioned clamping voltage with respect to node 26, VBO device 50 is maintained below its breakover voltage. Apart from the foregoing changes from ballast circuits 10 and 10', the description of parts of ballast 10" of FIG. 9 is the same as the above description of like-numbered parts for ballast circuits 10 and 10' of FIGS. 1 and 7.

Comparing the starting circuit shown in FIG. 9 with the starting circuit shown in FIG. 7, it will be seen that current-supply capacitor 59 used in FIG. 7 is not required in FIG. 9. Instead, driving inductor $L_D$ and second inductor 32 form an L-C (inductive-capacitive) circuit with capacitor 38", which is driven by the voltage pulse generated by the collapse of voltage in VBO device 50 when such device breaks over. Such an L-C network naturally tends to resonate towards an increase in voltage across the inductors, i.e., the gate-to-source voltage. Typically, after a few oscillations of such increasing gate-to-source voltage, one or the other of switches $Q_1$ and $Q_2$ will fire, depending on the polarity of the excursion of gate-to-source voltage that first reaches the threshold for turn-on of the associated switch.

The use of charging resistor 58 or of charging resistor 58' will determine the polarity of charging of capacitor 38" upon initial energization of d.c. voltage source 14. Such polarity of charge on capacitor 38" then determines the initial polarity of gate-to-source voltage generated by the L-C circuit mentioned in the foregoing paragraph, upon firing of VBO device 50. As also mentioned in the foregoing paragraph, however, the first switch to fire depends on a sufficient increase of gate-to-source voltage over several oscillations, so that it is usually indeterminate as to which switch will be turned on first. Proper circuit operation will result from either switch being turned on first.

Exemplary component values for the circuit of FIG. 9 are as follows for a lamp 60 rated at 13 watts, with a d.c. bus voltage of 160 volts, and not including inductor 34:

| | |
|---|---|
| Resonant inductor $L_R$ | 20 micro henries |
| Driving inductor $L_T$ | 0.2 micro henries |
| Turns ratio between $L_R$ and $L_D$ | 10 |
| Second inductor 32 | 30 micro henries |
| Capacitor 38" | 470 picofarads |
| Zener diodes 36, each | 7.5 volts |
| Resistors 54, 56, 58, and 58', each | 100k ohms |
| Resonant capacitor $C_R$ | 680 picofarads |
| D.c. blocking capacitor 64 | 1 nanofarad |

Additionally, switch $Q_1$ may be an IRFR210, n-channel, enhancement mode MOSFET, sold by International Rectifier Company, of El Segundo, Calif.; switch $Q_2$ an IRFR9210, p-channel, enhancement mode MOSFET also sold by International Rectifier Company; and VBO device 50, a diac sold by Philips Semiconductors of Eindhoven, Netherlands, with a 34-volt breakover voltage, part No. BR100/03.

Figure 10:
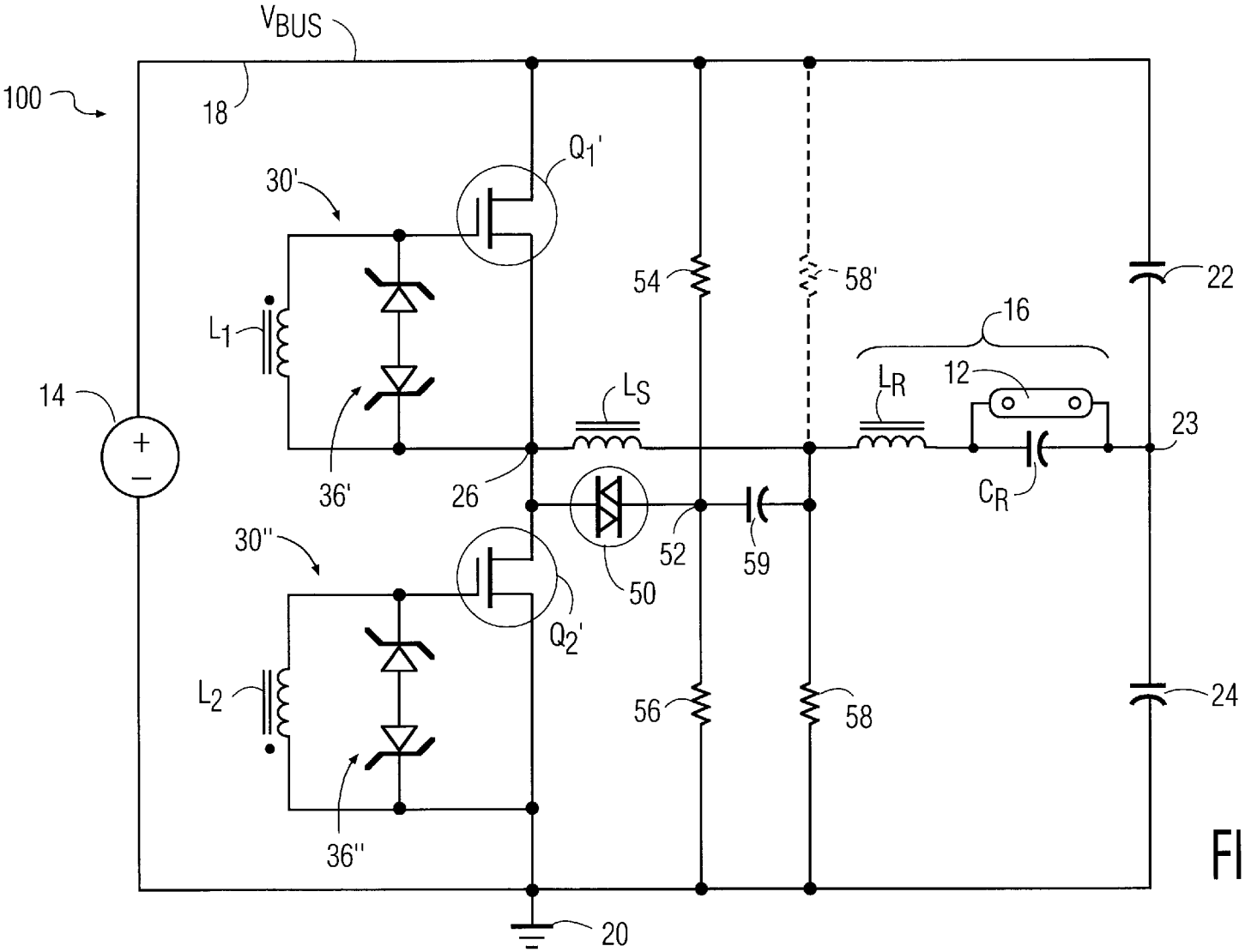
FIG. 10 is a schematic diagram showing a ballast circuit employing a starting circuit in conjunction with a d.c.-to-a.c. converter using non-complementary switches.

FIG. 10 shows a ballast circuit 100 employing a starting circuit in conjunction with switches $Q_1$' and $Q_2$', which are non-complementary to each other; i.e., both may be n-channel, enhancement mode MOSFETs, for example. Like reference numerals as between FIG. 10 and FIG. 7 refer to like parts, except as otherwise noted. Thus, for instance, the starting circuit in FIG. 10 includes VBO device 50 and resistors 54 and 56 forming a voltage-divider network to help maintain second node 52 at a voltage during steady state lamp operation which prevents VBO device 50 from firing. In this regard, capacitor 59 cooperates with resistors 54 and 56 by serving as a low pass filter to prevent high frequency fluctuations in voltage from firing VBO device 50 during steady state operation. It also includes a current-supply capacitor. 59 effectively shunted across the VBO device for supplying current to such device after it fires to assure that the voltage across the device falls sufficiently and rapidly enough to generate an effective starting pulse. Further, it employs a charging resistor 58 or 58' for charging capacitor 59 with one or the other polarity. However, instead of employing capacitor 38' as in FIG. 7 for coupling the voltage pulse generated by the VBO device to inductors $L_D$ and 32, ballast circuit 100 of FIG. 10 employs a current-sense winding $L_S$ for coupling the voltage pulse to oppositely poled windings $L_1$ and $L_2$ of gate drive circuits 30' and 30", respectively.

Gate drive circuits 30' and 30" are of conventional construction insofar as they include the mentioned windings $L_1$ and $L_2$, and respective bidirectional voltage clamps 36' and 36", respectively, e.g., of back-to-back Zener diodes as shown.

In operation, capacitor 59 is charged via one or the other charging paths including resistor 58 or resistor 58'. Capacitor 59 is effectively shunted across VBO device 50, because the impedance of sense inductor $L_S$ can be neglected. When the voltage across capacitor 59 reaches the breakover voltage of VBO device 50, a pulse of voltage from such device is coupled via sense inductor $L_S$ to oppositely poled windings $L_1$ and $L_2$. Depending upon which of charging resistor 58 or 58' is used, one or the other of gate drive circuits 30' and 30" will cause its associated switch to turn on.

In the circuit of FIG. 10, the positions of VBO device 50 and shunting capacitor 59 can be interchanged without departing from the principles of operation set forth herein.

Exemplary component values for the circuit of FIG. 10 are as follows for a lamp 12 rated at 16.5 watts, with a d.c. bus voltage of 160 volts:

| | | |
|---|---|---|
| Resonant inductor $L_R$ | 570 | micro henries |
| Sense inductor $L_S$ | 10 | micro henries |
| Inductors $L_1$ and $L_2$, each | 1 | millihenry |
| Turns ratio between $L_S$ and $L_1/L_2$ | 10 | |
| Zener diodes 36' and 36", each | 7.5 | volts |
| Resistors 54, 56, 58, and 58', each | 100k | ohms |
| Resonant capacitor $C_R$ | 3.3 | nanofarads |
| Bridge capacitors 22 and 24, each | 0.22 | microfarads |

Additionally, switches $Q_1$' and $Q_2$' may be IRFR214, n-channel, enhancement mode MOSFETs, sold by International Rectifier Company, of El Segundo, Calif.; and VBO device 50, a diac sold by Philips Semiconductors of Eindhoven, Netherlands, with a 34-volt breakover voltage, part No. BR100/03.

All of the starting circuits described herein benefit from simplicity of construction, whereby, for instance, they do not require a p-n diode as is required in typical prior art starting circuits. Rather, the p-n diode can be replaced by resistors for a fraction of the cost of a p-n diode.

While the invention has been described with respect to specific embodiments by way of illustration, many modifications and changes will occur to those skilled in the art. It is therefore, to be understood that the appended claims are intended to cover all such modifications and changes as fall within the true spirit and scope of the invention.

What is claimed is:

1. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising first and second switches serially connected between a bus conductor at a d.c. voltage and a reference conductor, and being connected together at a common node through which said a.c. current flows;

(c) a voltage-breakover (VBO) device connected between said common node and a second node;

(d) a network for preventing refiring of said VBO device when the lamp is operating at steady state, and wherein no unidirectional-conducting diode is used in said network in a clamping function for the foregoing purpose; and (e) a polarity-determining impedance connected between said common node and one of said bus conductor and said reference conductor, to set the initial polarity of pulse to be generated upon the firing of said VBO device.

2. The ballast circuit of claim 1, further comprising a starting capacitor arranged to be charged through said polarity-determining impedance in a polarity depending upon whether such impedance is connected to said bus conductor or to said reference conductor.

3. The ballast circuit of claim 1, wherein said VBO device is a diac.

4. The ballast circuit of claim 1, further comprising a current-supply capacitor shunted across said VBO for supplying current to said device after it fires to assure that the voltage across said device falls sufficiently and rapidly enough to generate an effective starting pulse.

5. The ballast circuit of claim 1, wherein:

(a) said network comprises first and second impedances serially connected together between said bus conductor and said reference conductor; and (b) the common connection point of said first and second impedances is connected to said second node.

6. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising first and second switches serially connected between a bus conductor at a d.c. voltage and a reference conductor, being connected together at a common node through which said a.c. current flows, and each having a control node and a reference node, the voltage between which nodes determines the conduction state of the associated switch;

(c) a feedback arrangement for controlling the conduction states of said switches, said arrangement comprising a transformer having:

(i) a first winding connected between the control and reference nodes of said first switch;

(ii) a second winding connected between the control and reference nodes of said second switch; said second transformer winding being oppositely poled with respect to said first transformer winding; and (iii) a current-sensing winding mutually coupled to said first and second windings for sensing current through said resonant load circuit;

(d) a voltage-breakover (VBO) device connected between said common node and a second node;

(e) a network for preventing refiring of said VBO device when the lamp is operating at steady state, and wherein no unidirectional-conducting diode is used in a clamping function for the foregoing purpose;

(f) a current-supply capacitor shunted across said VBO for supplying current to said device after it fires to assure that the voltage across said device falls sufficiently and rapidly enough to generate an effective starting pulse;

(g) a polarity-determining impedance connected between said common node and one of said bus conductor and said reference conductor, to set the initial polarity of pulse to be generated upon the firing of said VBO device; and (h) said current-sensing winding of said feedback arrangement being positioned to receive a pulse of current generated upon said VBO device firing, so as to induce in said first and second transformer windings a start-up pulse upon receiving said pulse of current.

7. The ballast circuit of claim 6, wherein said current-sensing winding is directly connected between a node of said VBO device and a node of said current-supplying capacitor that is remote from said VBO device.

8. The ballast circuit of claim 6, wherein each of said first and second windings is shunted by a respective bidirectional voltage clamp for limiting its positive and negative excursions.

9. The ballast circuit of claim 6, wherein:

(a) said network for setting the voltage comprises first and second impedances serially connected together between said bus conductor and said reference conductor; and (b) the common connection point of said first and second impedances is connected to said second node.

10. The ballast circuit of claim 6, wherein said VBO device is a diac.

11. A ballast circuit for a gas discharge lamp, comprising:

(a) a resonant load circuit incorporating the gas discharge lamp and including a resonant inductance and a resonant capacitance;

(b) a d.c.-to-a.c. converter circuit coupled to said resonant load circuit for inducing an a.c. current in said resonant load circuit, said converter circuit comprising:

(i) first and second switches serially connected between a bus conductor at a d.c. voltage and a reference conductor, and being connected together at a common node through which said a.c. current flows;

(ii) said first and second switches each comprising a control node and a reference node, the voltage between such nodes determining the conduction state of the associated switch;

(iii) the respective control nodes of said first and second switches being interconnected; and (iv) the respective reference nodes of said first and second switches being connected together at said common node;

(c) a voltage-breakover (VBO) device connected between said common node and a second node;

(d) a diodeless network for preventing refiring of said VBO device when the lamp is operating at steady state, and wherein no unidirectional-conducting diode is used in a clamping function for the foregoing purpose;

(e) a polarity-determining impedance connected between said common node and one of said bus conductor and said reference conductor, to set the initial polarity of pulse to be generated upon the firing of said VBO device;

(f) an inductance connected between said control nodes and said common node; and (g) a device for coupling a voltage pulse generated in said VBO device after it fires to said inductance for inducing a starting voltage pulse across said inductance.

12. The ballast circuit of claim 11, wherein said inductance comprises:

(a) a driving inductor mutually coupled to said resonant inductor in such manner that a voltage is induced therein which is proportional to the instantaneous rate of change of said a.c. load current; and (b) a second inductor serially connected to said driving inductor, with the serially connected driving and second inductors being connected between said common node and said control nodes;

(b) a bidirectional voltage clamp being connected between said common node and said control nodes for limiting positive and negative excursions of voltage of said control nodes with respect to said common node; and (c) said second inductor cooperating with said voltage clamp is such manner that the phase angle between the fundamental frequency component of voltage across said resonant load circuit and said a.c. load current approaches zero during lamp ignition.

13. The ballast circuit of claim 11, wherein said device for coupling comprises a capacitor connected between said control nodes and said reference node.

14. The ballast circuit of claim 11, wherein:

(a) said network comprises first and second impedances serially connected together between said bus conductor and said reference conductor; and (b) the common connection point of said first and second impedances is connected to said second node.

15. The ballast circuit of claim 11, further comprising a current-supply capacitor shunted across said VBO for supplying current to said device after it fires to assure that the voltage across said device falls sufficiently and rapidly enough to generate an effective starting pulse.

16. The ballast circuit of claim 11, wherein:

(a) the ballast circuit further comprises a starting capacitor arranged to be charged through said polarity-determining impedance in a polarity, depending upon whether such impedance is connected to said bus conductor or to said reference conductor; and (b) said inductance and said starting capacitor form a parallel inductance-capacitance circuit which is driven by a voltage pulse induced in said inductance upon firing of said VBO device, so as to increase in voltage due to a resonant effect between said inductance and starting capacitor to a point sufficient to cause one of said first and second switches to become conductive.

17. The ballast circuit of claim 5, wherein said first and second impedances respectively comprise resistors.

18. The ballast circuit of claim 9, wherein said first and second impedances respectively comprise resistors.

19. The ballast circuit of claim 14, wherein said first and second impedances respectively comprise resistors.

20. The ballast circuit of claim 1, wherein said VBO device is directly connected between said common node and said second node.

21. The ballast circuit of claim 6, wherein said VBO device is directly connected between said common node and said second node.

22. The ballast circuit of claim 11, wherein said VBO device is directly connected between said common node and said second node.

* * * * *